US006683400B2

(12) United States Patent
Okumura

(10) Patent No.: US 6,683,400 B2
(45) Date of Patent: Jan. 27, 2004

(54) INCANDESCENT BULB FOR A MOTOR VEHICLE

(75) Inventor: Yoshihiko Okumura, Hyogo-ken (JP)

(73) Assignee: Ushiodenki Kabushiki Kaisha, Tokyo (JP)

( * ) Notice: Subject to any disclaimer, the term of this patent is extended or adjusted under 35 U.S.C. 154(b) by 0 days.

(21) Appl. No.: 10/197,548

(22) Filed: Jul. 18, 2002

(65) Prior Publication Data

US 2003/0042835 A1 Mar. 6, 2003

(30) Foreign Application Priority Data

Aug. 16, 2001 (JP) ..... 2001-247005

(51) Int. Cl.[7] ..... H01J 1/14
(52) U.S. Cl. ..... 313/345
(58) Field of Search ..... 313/311, 315, 313/345, 355, 575, 631

(56) References Cited

U.S. PATENT DOCUMENTS 3,771,017 A * 11/1973 Switsen ..... 315/200 R
3,927,989 A * 12/1975 Koo ..... 419/4
4,499,401 A * 2/1985 Graves et al. ..... 313/315
5,349,265 A * 9/1994 Lemelson ..... 313/345

FOREIGN PATENT DOCUMENTS

JP 55-117768 8/1980
JP 05-36387 2/1993

* cited by examiner

*Primary Examiner*—Don Wong
*Assistant Examiner*—Minh D A
(74) *Attorney, Agent, or Firm*—Nixon Peabody LLP; David S. Safran

(57) ABSTRACT

To devise an incandescent bulb for a motor vehicle with a new arrangement which can withstand vibration during driving of a motor vehicle to a sufficient degree, an envelope is provided with a unilateral sealed portion which is preferably made of a glass that has quartz as the main component; at least two feed lines extend as inner leads into the envelope; and at least one filament coil of which the main component is tungsten and which forms an emission part, has one end connected to one of the lines and the other end connected to the other of the feed lines, and the filament coil has a spring constant of at least 25 g/mm and a weight of at most 100 mg. Furthermore, advantageously, the inner leads are made of a material of which the main component is molybdenum, and the diameter of the inner leads is at least 0.48 mm.

13 Claims, 1 Drawing Sheet

INCANDESCENT BULB FOR A MOTOR VEHICLE

BACKGROUND OF THE INVENTION

1. Field of the Invention

The invention relates to an incandescent bulb for a motor vehicle. The invention relates especially to an incandescent bulb for a motor vehicle with performance which can withstand vibration during driving with the motor vehicle to a sufficient degree.

2. Description of Related Art

A motor vehicle is provided with an incandescent bulb for illumination while driving. The incandescent bulb must of course withstand vibration during driving with the motor vehicle to a sufficient degree. As the international standard, IEC810 requires that vibration up to roughly 1000 Hz be tolerated. Conventionally, certain methods have been used and arrangements devised as measures against this vibration, such as the arrangement of a support or the like. However, in these processes, there was the disadvantage that production is difficult because several working sequences are required for production.

SUMMARY OF THE INVENTION

The primary object of the present invention is to devise an incandescent bulb for a motor vehicle with a new arrangement which can withstand vibration during driving of a motor vehicle to a sufficient degree.

The object is achieved as in accordance with the invention in an incandescent bulb for a motor vehicle which comprises the following:

an envelope with a unilateral sealed portion;

two feed lines which extend into this envelope; and at least one filament coil which forms an emission part, one end of which is connected to one of the feed lines and the other end of which is connected to the other feed line, and the main component of which is tungsten, wherein the filament coil has a spring constant of at least 25 g/mm and a weight at most equal to 100 mg.

The object is furthermore achieved as according to the invention by the main component of the above described inner lead being made of molybdenum having a diameter of at least 0.48 mm.

The object is moreover achieved by the envelope being made of glass, with quartz as the main component.

The invention is described in greater detail below with reference to the drawings.

DETAILED DESCRIPTION OF THE INVENTION

Figure 1:
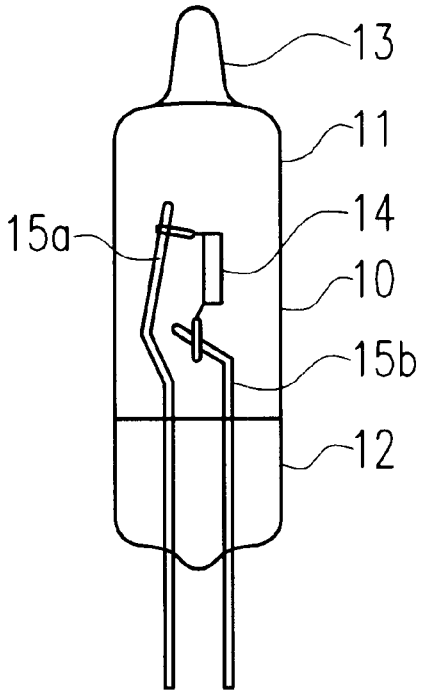
FIGS. 1 & 2 each show a schematic cross section of an incandescent bulb for a motor vehicle in accordance with the invention.
Figure 2:
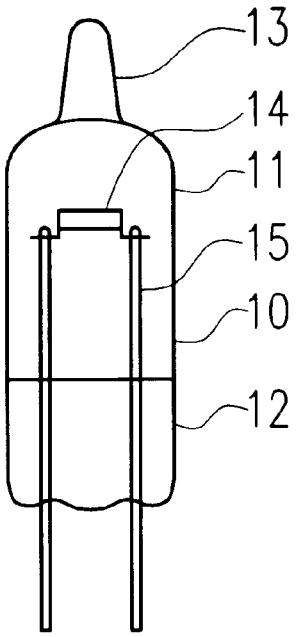

FIG. 1 shows the arrangement of an incandescent bulb 10 for a motor vehicle in accordance with the invention in which a filament coil 14 extends essentially along the longitudinal axis of the envelope 11. FIG. 2 shows an arrangement in which a filament coil 14 is located essentially horizontally relative to the longitudinal axis of the envelope 11. The main part of the incandescent bulb 10 for a motor vehicle comprises the envelope 11 which is made of a glass that has quartz as the main component. One end of the incandescent bulb 10 is provided with a hermetically sealed portion 12 and the other end has the remainder 13 of an outlet tube. The envelope 11 contains one or more filament coils 14, each of which forms an emission part that extends, as noted, either along the longitudinal axis of the envelope 11, or horizontally (perpendicular to the longitudinal axis of the envelope 11). The filament coil 14 is supported by supports (lines) 15*a*, 15*b*. The two supports 15*a*, 15*b* have different lengths when the filament coil 14 extends along the tube axis, as is shown in FIG. 1. The two supports 15*a*, 15*b* have the same length when the filament coil 14 is located horizontally (perpendicular to the lengthwise axis of the tube). For example, the envelope 11 is filled with inert gas and a halogen compound.

In order to specify, for example, numerical values as general quantities of a lamp for a motor vehicle, one example of a coil-like arrangement is shown in which the filament coil 14 is wound with long tungsten. Here, a tungsten wire with a strand diameter of 0.1 mm to 0.25 mm is wound roughly 10 to 25 times. In this way, a coil with a length of 3 mm to 8 mm and an outside diameter of 0.7 mm to 1.4 mm is formed. In the case of different lengths of the supports, the greater length is 7 to 18 mm and the smaller length is 3 mm to 10 mm, the outside diameter being 0.3 mm to 0.7 mm each.

If the material of this coil is inherently brittle, of course it cannot withstand vibration of the lamp. As a result of varied studies, the inventor has found that the weight and spring constant of the coil are important as features of such a vibration-proof arrangement. Since the lamp must withstand vibration up to 1000 Hz according to the above described international standard, with respect to whether up to 1000 Hz can be tolerated or not, the inventor has measured the relation between the spring constant of the filament coil for a motor vehicle and the vibration frequency.

The experiment was carried out as follows:

An incandescent bulb with a filament coil with the above described arrangement was placed in a vibration tester.

The vibration frequency was gradually changed from 10 Hz to 1000 Hz for 20 minutes and returned to 10 Hz when 1000 Hz were reached.

This process was repeated without interruption for 2 hours. During these two hours the lamps were operated without interruption with 13.2 V.

Cases in which it was possible to maintain operation without burning through during the two hours of the test were registered as vibration resistance "present," and cases in which burning-through took place during the two hours were registered as vibration resistance "absent." Five lamps with different spring constants of 8 g/mm, 12 g/mm, 25 g/mm, 37 g/mm and 67 g/mm were prepared, other conditions of the lamps within the above described ranges essentially corresponding to one another.

TABLE 1

| Lamp type | Spring constant (g/mm) | Vibration resistance |
|---|---|---|
| Lamp 1 | 8 | absent |
| Lamp 2 | 12 | absent |
| Lamp 3 | 25 | present |
| Lamp 4 | 37 | present |
| Lamp 5 | 67 | present |

It is apparent from the results shown in Table 1 that, in an arrangement of the filament coil of a lamp for a motor vehicle which is located within the ordinarily used numerical range, at least advantageous vibration resistance is obtained when the spring constant is 25 (g/mm) to 67 (g/mm). Here, the "spring constant" is defined as the weight which is necessary for tensioning (stretching) a spring by 1 mm. A "large" spring constant means that the filament coil is not highly tensioned. A "small" spring constant means that the filament coil is tensioned to a high degree. In the invention, the spring constant factor was considered as the extension constant and its numerical value range was established with respect to resistance to vehicle vibration because the filament coil serving as the emission part has a spring shape.

The weight of the filament coil is described below. The reason for this is that, even for a large spring constant, the filament coil can no longer withstand vibration up to 1000 Hz if the weight of this filament coil is inherently too great, and that there are, therefore, cases in which the filament coil burns through.

Therefore, the inventor observed, besides the spring constant of the filament coil 14, also the weight of the filament coil 14 to be an important factor and measured the relation between this weight and the vibration resistance property.

As in the above described case of the spring constant, the test was done using a vibration tester.

Four filament lamps with essentially the same spring constant (roughly 40 g/mm) and different weights of the filament coil of 14 mg, 45 mg, 86 mg and 107 mg were used, and in the same way as described above, a filament lamp was installed in the vibration tester, the vibration frequency was changed gradually from 10 Hz to 1000 Hz over the course of 20 minutes and when 1000 Hz were reached, the vibration frequency was returned to 10 Hz. This process was repeated for two hours without interruption. During these two hours, the lamps were operated without interruption with 13.2 V. Cases in which, during the two hours of the test, it was possible to maintain operation without burning through were registered as vibration resistance "present," and cases in which, during the two hours, burning-through took place were registered as vibration resistance "absent."

TABLE 2

| Lamp type | Filament coil weight (mg) | Vibration resistance |
|---|---|---|
| Lamp 1 | 14 | present |
| Lamp 2 | 45 | present |
| Lamp 3 | 86 | present |
| Lamp 4 | 107 | absent |

It is apparent from the test results shown in Table 2 that, at a weight of the filament coil of at most 100 mg, vibration resistance is ensured with respect to weight.

For such a vibration resistance property, of course with different shapes and sizes of the filament coil (14), the minimum weight which can be used in conjunction with vibration resistance also has different numerical values. In the general shape and general weight of the filament lamp in accordance with the invention for a motor vehicle, however, at a vibration frequency up to 1000 Hz which is established by the international standard, vibration can be adequately withstood when the spring constant is at least 25 mg/mm and the weight is at most 100 mg.

Next, the inventor observed the line (15*a*, 15*b*) which supports the filament coil. The above described establishment of the spring constant and of the weight of the filament coil (14) was of course done under the assumption that vibration does not take place to such a degree that the lines and the like have an adverse effect. This means that, for vigorous vibration of the lines, burning through does take place when driving, even if the spring constant and the weight of the filament coil are established in the above described manner.

In view of this disadvantage, the natural frequency of the lines was considered and checking was performed so that the lines are prevented from vibrating concomitantly during vibration up to the maximum vibration frequency of 1000 Hz which is fixed by the international standard. If the natural frequency of the lines can be set to at least 1000 Hz, at a frequency of less than 1000 Hz, the lines are prevented from vibrating in resonance, which occurs when driving a vehicle. This prevents the lines from causing the filament coil to burn through.

As a result of thorough studies, the inventor found that, for lines with molybdenum as the main component, the adjustment of their diameter value often has a major effect relative to the natural frequency.

Of the arrangements shown in FIG. 1, in the arrangement in which two lines with different lengths each proceed from the hermetically sealed portion and in which the filament coil also extends essentially in the same direction as the lines, the line with the greater length of the two lines (15*a*, FIG. 1) effects the vibration resistance.

Since the greater length of the line from the hermetically sealed portion to the connecting point with the filament coil in a incandescent bulb for a motor vehicle is 15 mm, the strand diameter of the line with a length of 15 mm was changed from 0.1 mm to 0.7 mm, the respective natural frequency was changed and a test was run. This showed that, for a strand diameter of at least 0.48 mm, the natural frequency is at least 1000 Hz.

Therefore, it happens that, when the diameter value of the line is set to at least 0.48 mm, the inner lead does not vibrate concomitantly with the vibrations when driving in the range up to the vibration frequency of 1000 Hz which is fixed by international standard.

As was described above, in the incandescent bulb of the invention for a motor the following effects can be obtained:

1. By fixing the spring constant and the weight of the filament coil, the filament coil can withstand vibration when driving within the vibration frequency range established by international standard.
2. By fixing the diameter of the line which supports the filament coil, the natural vibration frequency of the line can be fixed to be greater than or equal to the above described vibration frequency which is fixed by international standard. In this way the formation of resonance at less than or equal to this vibration frequency can be advantageously suppressed.

What is claimed is:

1. Incandescent bulb for a motor vehicle, comprising:

an envelope having a unilateral sealed portion;

at least two feed lines which extend into the envelope as an inner lead; and at least one filament coil made of a material of which the main component is tungsten, the at least one filament coil located in the envelope and forming an emission part, one end of the at least one filament coil being connected to one of the lines and another end of the at least one filament coil being connected to the other of the lines, wherein the at least one filament coil has a spring constant of at least 25 g/mm and a weight of at most 100 mg.

2. Incandescent bulb as claimed in claim 1, wherein the filament coil is made of a tungsten wire having a strand diameter of from 0.1 mm to 0.25 mm which is wound roughly 10 to 25 times so that a coil with a length of 3 mm to 8 mm and an outside diameter of 0.7 mm to 1.4 mm is formed.

3. Incandescent bulb as claimed in claim 2, wherein the inner leads have lengths which differ from each other and the at least one filament coil extends essentially between the inner leads in a direction parallel to a lengthwise axis of the envelope.

4. Incandescent bulb as claimed in claim 3, wherein a shorter one of the inner leads has a length from 3 mm to 10 mm and a longer one of the inner leads has a length from 7 mm to 18 mm.

5. Incandescent bulb as claimed in claim 2, wherein the inner leads are made of a material of which the main component is molybdenum, and wherein the diameter of the inner leads is at least 0.48 mm.

6. Incandescent bulb as claimed in claim 1, wherein the inner leads are made of a material of which the main component is molybdenum, and wherein the diameter of the inner leads is at least 0.48 mm.

7. Incandescent bulb as claimed in claim 6, wherein the inner leads have lengths which differ from each other and the at least one filament coil extends essentially between the inner leads in a direction parallel to a lengthwise axis of the envelope.

8. Incandescent bulb as claimed in claim 7, wherein a shorter one of the inner leads has a length from 3 mm to 10 mm and a longer one of the inner leads has a length from 7 mm to 18 mm.

9. Incandescent bulb as claimed in claim 6, wherein the inner leads have essentially the same length and the at least one filament coil is located essentially perpendicular to a lengthwise axis of the tube.

10. Incandescent bulb as claimed in claim 1, wherein the inner leads have lengths which differ from each other and the at least one filament coil extends essentially between the inner leads in a direction parallel to a lengthwise axis of the envelope.

11. Incandescent bulb as claimed in claim 10, wherein a shorter one of the inner leads has a length from 3 mm to 10 mm and a longer one of the inner leads has a length from 7 mm to 18 mm.

12. Incandescent bulb as claimed in claim 1, wherein the inner leads have essentially the same length and the at least one filament coil is located essentially perpendicular to a lengthwise axis of the envelope.

13. Incandescent bulb as claimed in claim 1, wherein the envelope is made of glass having quartz as the main component.

* * * * *